US005595115A

United States Patent [19]

Rau et al.

[11] Patent Number: 5,595,115

[45] Date of Patent: Jan. 21, 1997

[54] PRINTING MECHANISM INCLUDING MEANS FOR COOLING AND MEANS FOR MOUNTING SLEEVE SHAPED FORMS ON TRANSFER AND FORM CYLINDERS

[75] Inventors: Gunnar Rau, Königsbrunn; Karl H. Müller, Gersthofen, both of Germany

[73] Assignee: Man Roland Druckmaschinen AG, Offenbach am Main, Germany

[21] Appl. No.: 335,127

[22] Filed: Nov. 7, 1994

[30] Foreign Application Priority Data

Nov. 5, 1993 [DE] Germany ..... 9316932 U
Sep. 1, 1994 [DE] Germany ..... 44 31 188.5

[51] Int. Cl.[6] ..... B41L 29/00; B41L 35/14

[52] U.S. Cl. ..... 101/142; 101/216; 101/217; 101/220; 101/349; 101/375; 101/484; 101/487

[58] Field of Search ..... 101/141, 142, 101/450.1, 451, 216, 217, 219, 220, 348, 349, 350, 375, 376, 484, 487, 488, DIG. 38; 184/6.22, 104.1

[56] References Cited

U.S. PATENT DOCUMENTS

| | | | |
|---|---|---|---|
| 3,704,669 | 12/1972 | Christoff | 101/216 |
| 4,440,082 | 4/1984 | Carey et al. | 101/153 |
| 4,821,640 | 4/1989 | Hajek et al. | 101/248 |
| 4,903,599 | 2/1990 | Kübler et al. | 101/450.1 |
| 4,913,048 | 4/1990 | Tittgemeyer | 101/375 |
| 5,065,675 | 11/1991 | Tapper | 101/153 |
| 5,074,213 | 12/1991 | Kurosawa | 101/216 |
| 5,189,960 | 3/1993 | Valentini et al. | 101/487 |
| 5,215,013 | 6/1993 | Vrotacoe et al. | 101/375 |
| 5,241,905 | 9/1993 | Guaraldi et al. | 101/216 |
| 5,309,838 | 5/1994 | Kurz | 101/487 |

FOREIGN PATENT DOCUMENTS

| | | | |
|---|---|---|---|
| 0225509 | 6/1987 | European Pat. Off. . | |
| 0366395 | 5/1990 | European Pat. Off. . | |
| 0386316 | 9/1990 | European Pat. Off. . | |
| 0480230 | 4/1992 | European Pat. Off. . | |
| 2431371 | 3/1980 | France | 101/375 |
| 1035353 | 7/1958 | Germany . | |
| 3715536 | 12/1988 | Germany . | |
| 3726820 | 3/1989 | Germany . | |
| 4123957 | 1/1993 | Germany | 101/216 |
| 4202544A1 | 8/1993 | Germany . | |
| 9218193 U | 9/1993 | Germany . | |
| 9314968 U | 1/1994 | Germany . | |
| 9314967 U | 1/1994 | Germany . | |
| 4224443 | 1/1994 | Germany . | |
| 4332364 | 4/1994 | Germany . | |
| 9408328 | 9/1994 | Germany . | |
| 193366 | 11/1982 | Japan | 101/216 |
| 161152 | 8/1985 | Japan | 101/487 |
| 227749 | 10/1987 | Japan | 101/487 |
| 21453 | 1/1991 | Japan | 101/487 |
| 101938 | 4/1991 | Japan | 101/487 |
| 2207636 | 2/1989 | United Kingdom . | |

OTHER PUBLICATIONS

Farbwerktemperierung, Grapho Metronic, Jan. 24, 1983.

*Primary Examiner*—Stephen R. Funk
*Attorney, Agent, or Firm*—Cohen, Pontani, Lieberman, Pavane

[57] ABSTRACT

A printing mechanism for waterless offset printing including a form cylinder that carries a sleeve-shaped printing form and/or a transfer cylinder that carries a sleeve-shaped transfer form such that the forms can be slipped onto or removed from their respective cylinder. Both the transfer cylinder and the form cylinder having internal and external cooling arrangements.

28 Claims, 5 Drawing Sheets

PRINTING MECHANISM INCLUDING MEANS FOR COOLING AND MEANS FOR MOUNTING SLEEVE SHAPED FORMS ON TRANSFER AND FORM CYLINDERS

FIELD OF THE INVENTION

The invention is directed to a printing mechanism for waterless offset printing using a form cylinder, a transfer cylinder, an impression cylinder, an inking mechanism and a cooling device.

DESCRIPTION OF THE PRIOR ART

DE 42 02 544 A1 discloses a blown-air cooling device for cooling the printing form in the waterless offset process. For this purpose, a blowing box is arranged along the form cylinder. The blowing box sucks in air through a water-cooled heat exchanger by means of ventilators and blows the air against the form cylinder. A disadvantage in printing mechanisms of this type is that the transfer cylinder becomes very hot. This heat results from the intensive flexing work of the rubber blanket and cannot be adequately carried off because of poor transmission of heat to adjacent cylinders. Printing ink builds up on the warm transfer cylinder; that is, the printing points carry too much ink. Accordingly, in order to prevent smeared printing, the printing press operator is obliged to wash the printing blankets frequently, which requires that the machine be stopped. Furthermore, the accumulation of ink on the rubber blanket increases pressure as the transfer cylinder rolls against the form cylinder and impression cylinder, which results in destruction of the rubber blanket. The grooves for clamping either the rubber blanket or a continuous printing form also cause mechanical vibrations and reduce the usable printing surface of a form cylinder or transfer cylinder. An additional disadvantage is that it is time-consuming to exchange a continuous printing form.

SUMMARY OF THE INVENTION

The object of the present invention is to provide a printing mechanism for waterless offset printing that prevents the build-up of printing ink on the rubber blanket. Additional objects include improving printing quality and the dynamics of the printing mechanism.

Pursuant to this object, and others which will become apparent hereafter, one aspect of the present invention resides in a printing mechanism in which the form cylinder carries a sleeve-shaped printing form and/or the transfer cylinder carries a sleeve-shaped transfer form. The printing form and the transfer form can be slipped onto or removed from their respective cylinder via an opening in the side wall of the printing machine. Mechanical vibrations are prevented through the use of a sleeve-shaped printing form and/or transfer form. This is most effective when both printing form sleeves and transfer form sleeves are used. In this way, printing quality can be improved and the output of the printing press can be increased. It also provides the possibility of continuous printing. Furthermore, the sleeves can be changed quickly.

Grooves on the transfer cylinder or form cylinder for clamping the rubber blanket or printing form can be dispensed with by using sleeves so that these cylinders can have a lightweight design. Such a cylinder, in turn, can easily be outfitted with internal cooling which cools very effectively.

Moreover, the blowing device cools the printing form and transfer form. Accordingly, the transfer form does not tend to accumulate printing ink. In this way, good printing quality is achieved while retaining normal rubber blanket washing cycles and the rubber blanket is preserved.

Pursuant to a further embodiment of the invention, internal cooling is provided for at least one of the transfer cylinder, the form cylinder, the ink distributing rollers and the ink fountain roller.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
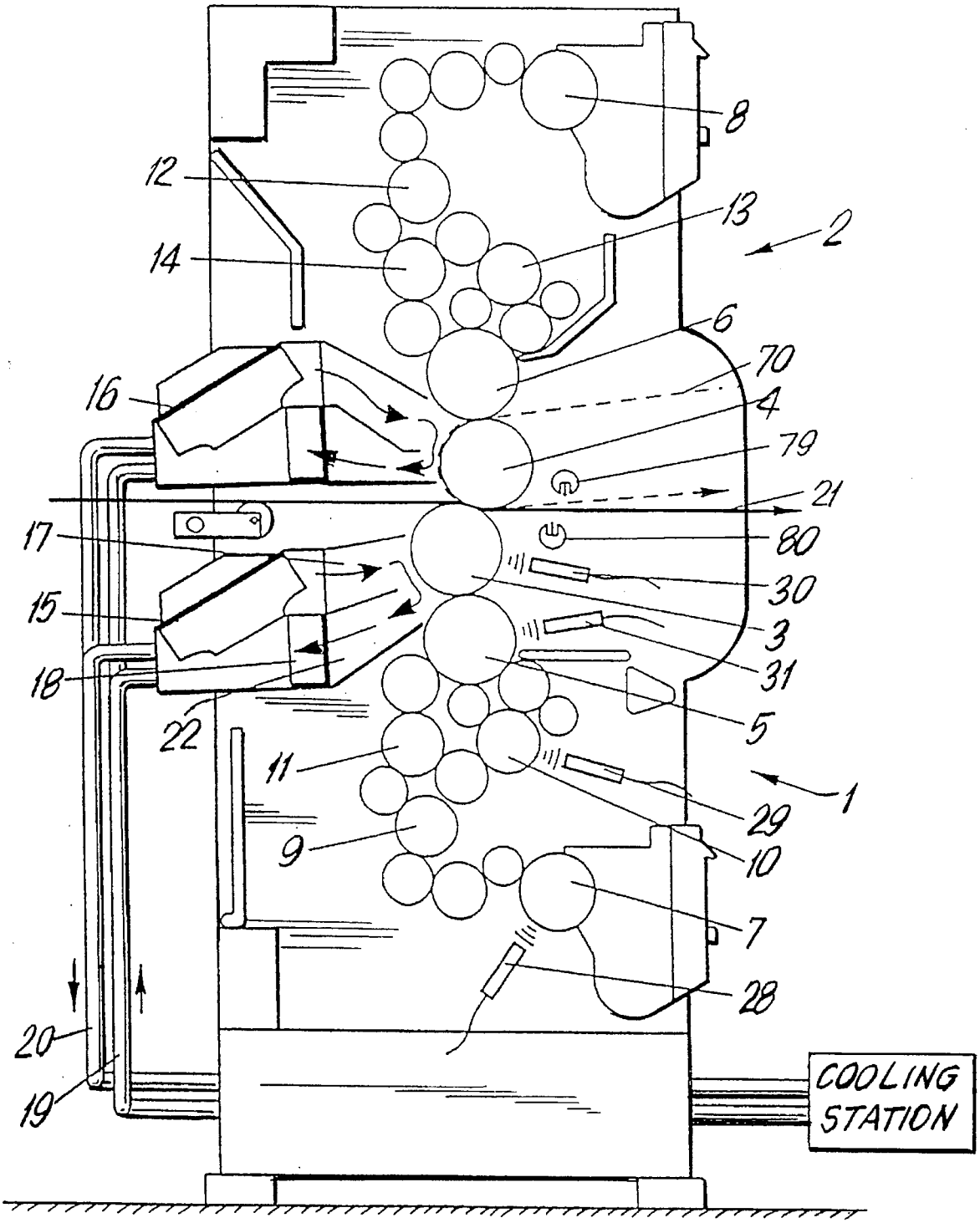
FIG. 1 is a side view of a printing unit with two printing mechanisms for waterless offset printing.

The printing unit shown in FIG. 1 has printing mechanisms 1, 2. Each printing mechanism 1, 2 has a transfer cylinder 3, 4 and a form cylinder 5, 6. An inking mechanism containing an ink fountain roller 7, 8 and three ink distributing rollers 9 to 14, in addition to the ink fountains and diverse inking rollers, is arranged at each form cylinder 5, 6. A blowing device 15, 16 is associated with each transfer cylinder and form cylinder pair, 3, 5 and 4, 6, respectively, along its axis, i.e., its blowing opening 17 is directed to the paired transfer cylinders and form cylinders 3, 5 and 4, 6, respectively. Each blowing device 15, 16 has a heat exchanger 18 which is connected to a coolant feed 19 and a coolant return 20, the coolant being supplied from a cooling station.

During a printing operation, the two transfer cylinders 3, 4 are advanced toward one another and print on the web 21 which is guided between them. In so doing, the printed image is inked on the printing forms clamped on the form cylinders 5, 6, transferred to the transfer cylinders 3, 4 and applied by the latter to both sides of the web 21. Each blowing device 15, 16 sucks in air by means of a fan via the intake duct 22 and heat exchanger 18 through which the coolant flows. In so doing, the air is cooled and is subsequently blown against the transfer cylinders 3, 4 and the form cylinders 5, 6 so that these cylinders are cooled.

Figure 2:
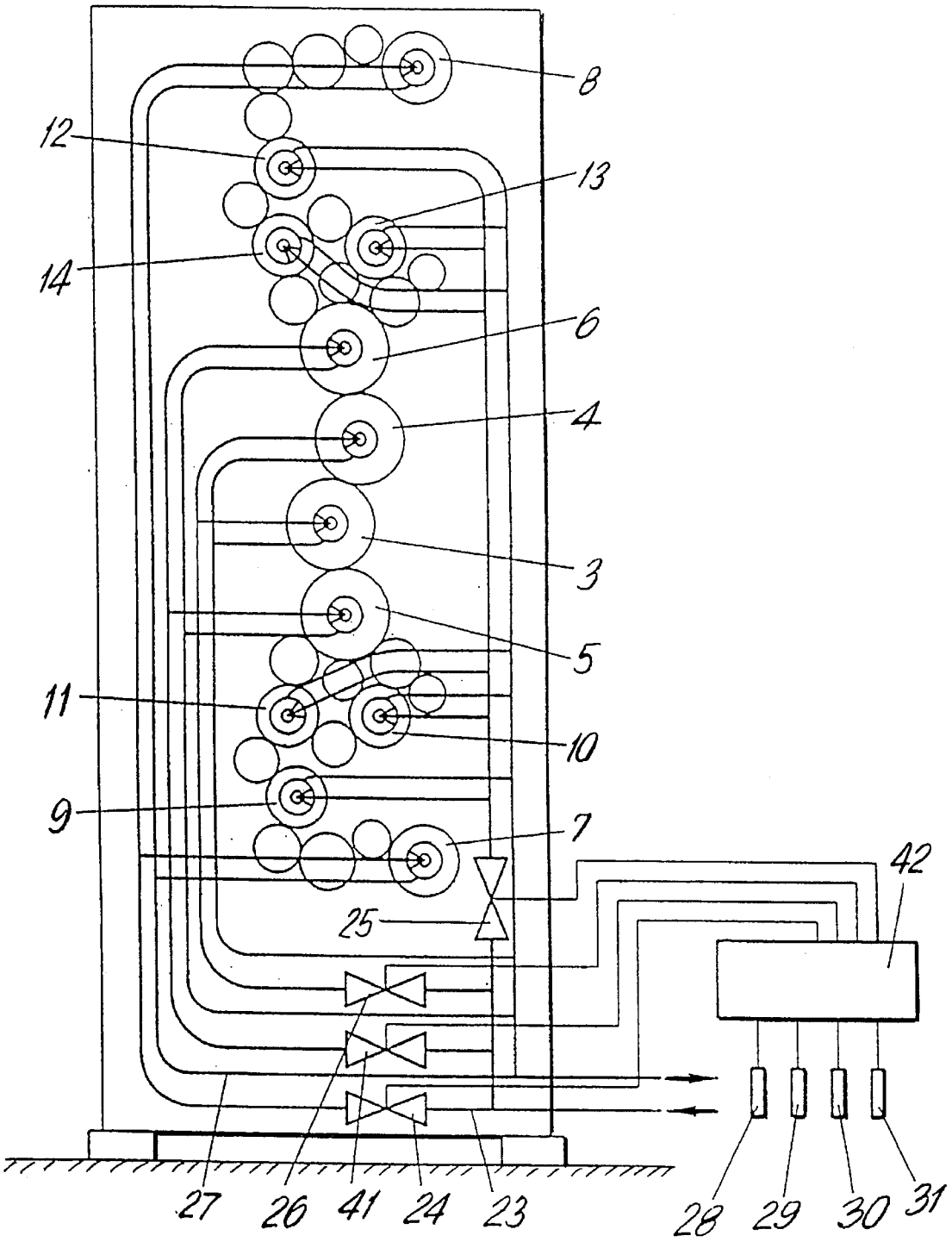
FIG. 2 illustrates the internal cooling of the ink distributing rollers, ink fountain rollers, transfer cylinder and form cylinder.

Additional possibilities for cooling, which will be described below can also be used optionally. This will be shown in particular with reference to web-fed printing with its high printing speeds. On the one hand, separate blowing devices can be provided for the transfer cylinders and form cylinders. On the other hand, the transfer cylinders, form cylinders, ink distributing rollers and ink fountain rollers can also be provided with internal cooling, e.g., water cooling. A variant is shown in FIG. 2. In this instance, a coolant feed 23 branches to the two ink fountain rollers 7, 8, the six ink distributing rollers 9 to 14, the two transfer cylinders 3, 4 and the two form cylinders 5, 6, with the intermediary of regulating valves 24, 25, 26, 41. The connection is made at the neck of the cylinders on the access side or operating side. The outlet 27 is also connected in this location. The regulating valves 24, 25, 26 and 41 are actuated by thermal sensors, e.g., infrared sensors, with the intermediary of regulators. For this purpose, thermal sensors 28 to 31 are arranged at the ink fountain roller 7, the ink distributing roller 10, the transfer cylinder 3 and the form cylinder 5. Thermal sensor 28 is provided for regulating valve 24, thermal sensor 29 is provided for regulating valve 25, thermal sensor 30 is provided for regulating valve 26, and thermal sensor 31 is provided for regulating valve 41. The regulators are contained in the regulating device 42 (FIG. 2). Furthermore, both thermal sensor 31 and thermal sensor 29 lead to a common regulator.

Depending on the deviation of the signals of the thermal sensors 28 to 31 from the reference value, the respective regulating valves 24 to 26 and 41 are further opened or closed so as to increase or reduce the amount of coolant supplied to the corresponding cylinder. The coolant is supplied from a cooling station at a low temperature, e.g., 12° C. The inking mechanism is cooled to a temperature of approximately 25° C. to 27° C., the printing plate is cooled to approximately 28° C. to 30° C., and the transfer cylinder is cooled to approximately 34° C. to 35° C. The ink fountain roller is advantageously maintained at a higher temperature than the inking mechanism, e.g., at 28° C. to 30° C., because the ink would otherwise become ropy and interfere with the delivery of ink. This procedure is made possible by separate regulating circuits. A good partial cooling of the form cylinder may already be achieved by the inking mechanism due to contact of the form inking roller or applicator roller with thick layers of ink and by the ink transfer itself. Therefore, the temperature of the form cylinder can also be regulated by thermal sensor 31 alone when thermal sensor 29 is omitted.

Figure 3:
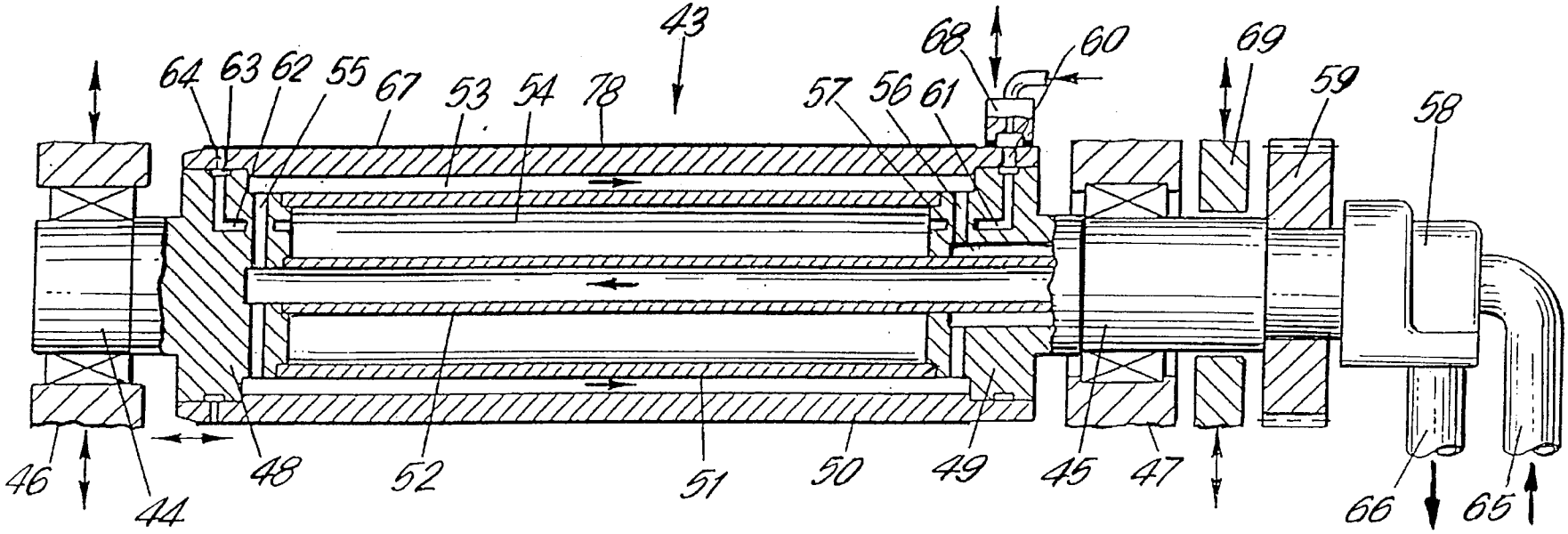
FIG. 3 shows a form cylinder in section.

The use of internal cooling in transfer cylinders and form cylinders is indicated in particular when a sleeve is used, because the cylinder may then be constructed with thin walls in a lightweight design while omitting a clamping groove. The design of such a form cylinder 43 is shown in FIG. 3. A transfer cylinder can have the same construction. The form cylinder 43 is supported by its neck 44, 45 in side walls 46, 47. The necks 44, 45 have flanges 48, 49 by which they are received in a cylinder jacket 50. Further, a separating tube 51 and a feed tube 52 are fastened in the flanges 48, 49. The separating tube 51, together with the cylinder jacket 50, forms a cooling chamber 53 and, together with the feed tube 52, forms a pressure chamber 54. The cooling chamber 53 is connected with the feed tube 52 via connection bores 55 in flange 48 and with a discharge duct 57 by connection bores 56 in flange 49. The feed tube 52 and the discharge duct 57 lead through the neck 45 on the drive side to a connecting head 58 arranged on the neck. Additionally, a spur wheel 59 for driving the cylinder 43 is mounted on the neck 45.

The form cylinder 43 carries a connection bore hole 60 for compressed air at the edge of its jacket 78 on the drive side. This connection bore hole 60 communicates with the pressure chamber 54 via a duct 61. A duct 62 leads from the pressure chamber 54 to an annular groove 63 from which radial bore holes 64 lead out of the cylinder jacket 78 at the edge on the operating side. A feed line 65 and a drain line 66 for the coolant are connected at the connecting head 58. The coolant flows through the feed tube 52 via the connection bores 55 to the cooling chamber 53 and is then guided out of the form cylinder 43 again via the connection bores 56, discharge duct 57 and connecting head 58. As it passes the cooling chamber 53, the coolant effectively cools the cylinder jacket 50. Circulation in the cooling chamber 53 can be advantageously effected by spiral guide plates or baffle plates (not shown). Compressed air is allowed to flow out of the radial bores 64 so that the sleeve-shaped printing form 67 can be slipped onto or under or removed from the form cylinder 43 more easily. This compressed air is introduced into the form cylinder 43 by means of a connecting shoe 68 arranged on the connection bore hole 60. The compressed air can also be introduced at the end side of the cylinder body. For the purpose of changing the printing form, the side wall 46 of the printing press on the operating side has bearing members which slide apart and whose movement is indicated by double arrows. Constructions for this purpose and also for a holding device 69 which holds the form cylinder in a suspended or floating manner when its neck 44 has been released are known to the person skilled in the art and need not be discussed at greater length. After the neck is released and an opening is created in the side wall 46, the sleeve-shaped printing form 67 can be exchanged. A sleeve-shaped transfer form can be slipped onto or removed from a transfer cylinder in the same way.

Figure 4:
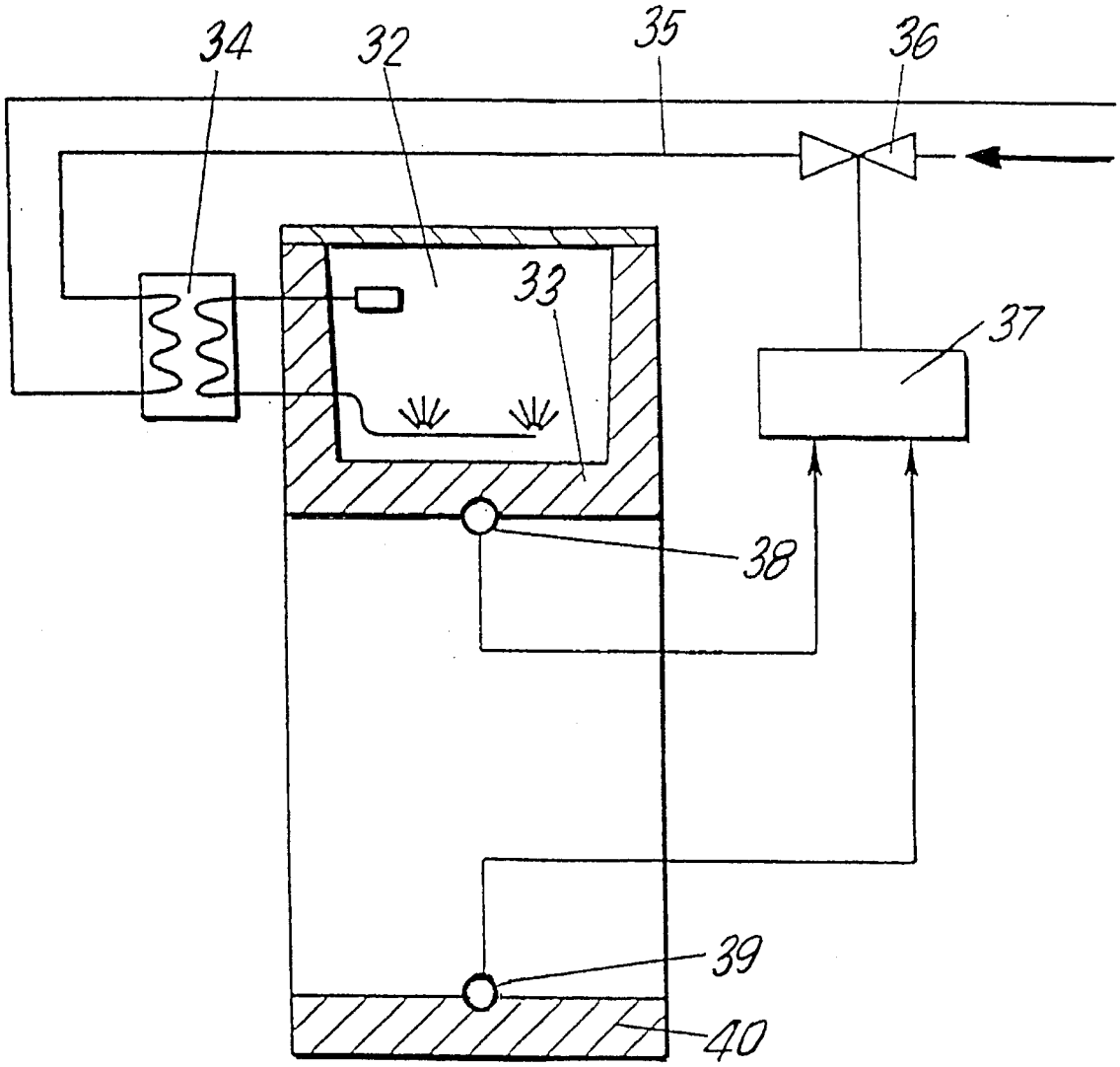
FIG. 4 is a top view of a printing unit with a device for regulating the temperature of the side walls.

According to FIG. 4, the lubricant of the gear case 32 on the side wall 33 on the drive side which is to be circulated by a pump, is guided via a heat exchanger 34. The coolant in a coolant circuit 35 flows through this heat exchanger 34. A regulating valve 36, which is controlled by a regulator 37, is located at the head of this coolant circuit. The outputs of two thermal sensors 38, 39, one of which is arranged at the wall 33 on the drive side and the other at the wall 40 on the operating side, are guided to the input side of the regulator 37. Resistance thermometers are advantageously used as thermal sensors, platinum (Pt 100) being particularly well-suited for this purpose since its resistance changes in proportion to temperature.

The regulating circuit serves to maintain the same temperature at the side wall 33 on the drive side and the side wall 40 on the operating side. Normally, the side wall 33 on the drive side has a higher temperature than the side wall 40 on the operating side because of the friction losses of the gearing in the gear case 32 which are converted into heat. As a result, the temperature does not remain constant over the length of the cylinders supported in the side walls 33, 40. Consequently, the temperature ratios of the supported cylinders cannot be optimally adjusted along their length. The regulator 37 is adjusted in such a way that the regulating valve 36 opens when the temperature of the side wall 33 on the drive side is higher than that of the side wall 40 on the operating side and the lubricant of the gear case 32 is accordingly cooled provided that coolant flows through the heat exchanger 34 at an appropriate rate. As it circulates, this lubricant in turn cools the side wall 33 on the drive side to the temperature of the side wall 40 on the operating side. When the temperature is the same on both side walls, the temperature of the printing mechanism cylinders is constant along their length and a prerequisite for good printing quality over the entire printing width has been achieved.

The fact that the individual coolant circuits are provided with coolant by one cooling station or by a plurality of cooling stations has no bearing on the use of the present invention. The printing mechanisms can also be outfitted with separate regulating circuits at low cost. Conversely, good results can be achieved in an economical manner by connecting additional printing units to the regulating devices of the printing mechanism 1. Coolant supply and fan output can also be regulated in the blowing devices. Water is advantageously used as coolant.

Furthermore, the coolant circuits can be used in a preparatory phase prior to printing for preheating the printing mechanisms by first supplying an appropriately heated coolant. This prevents the ink from pulling at the start of the printing process and the resulting accumulation of paper particles in the inking mechanism. This is very important since a moistening mechanism which could remove particles from the printing mechanism is not provided in waterless offset printing. The cooling station is then regulated so that the temperature of the coolant is gradually lowered as printing continues. To preheat the printing mechanism, the printing press operator makes use of the cooling circuits described above and those shown in FIGS. 1 and 2 and sets the thermostat of the cooling station to a higher coolant temperature which is advantageously the operating temperature of the ink distributing rollers. The printing press operator then gradually adjusts the coolant temperature to a lower setting corresponding to the increased cooling requirement brought about by the inherent heating of the printing mechanism whose temperature can be read at the thermometer. With the aid of a regulator, the coolant temperature curve for preheating can also be regulated on the basis of a temperature-time curve stored in memory or by means of a temperature sensor, e.g., at an ink distributing roller. For example, the thermal sensor 29 at the ink distributing roller 10 can be used. The memory unit can be accommodated in the regulating device 42.

A web can also be printed by the direct lithography or di-litho process, as it is called. The path of the web in this case is shown in dashed lines in FIG. 1. The web 70 is guided between the transfer cylinder 4 and the form cylinder 6 and is printed by the latter. As the web 70 subsequently passes between transfer cylinder 4 and transfer cylinder 3, a second color is printed on the printed side of the web, resulting in a 2+0 printing.

Figure 5:
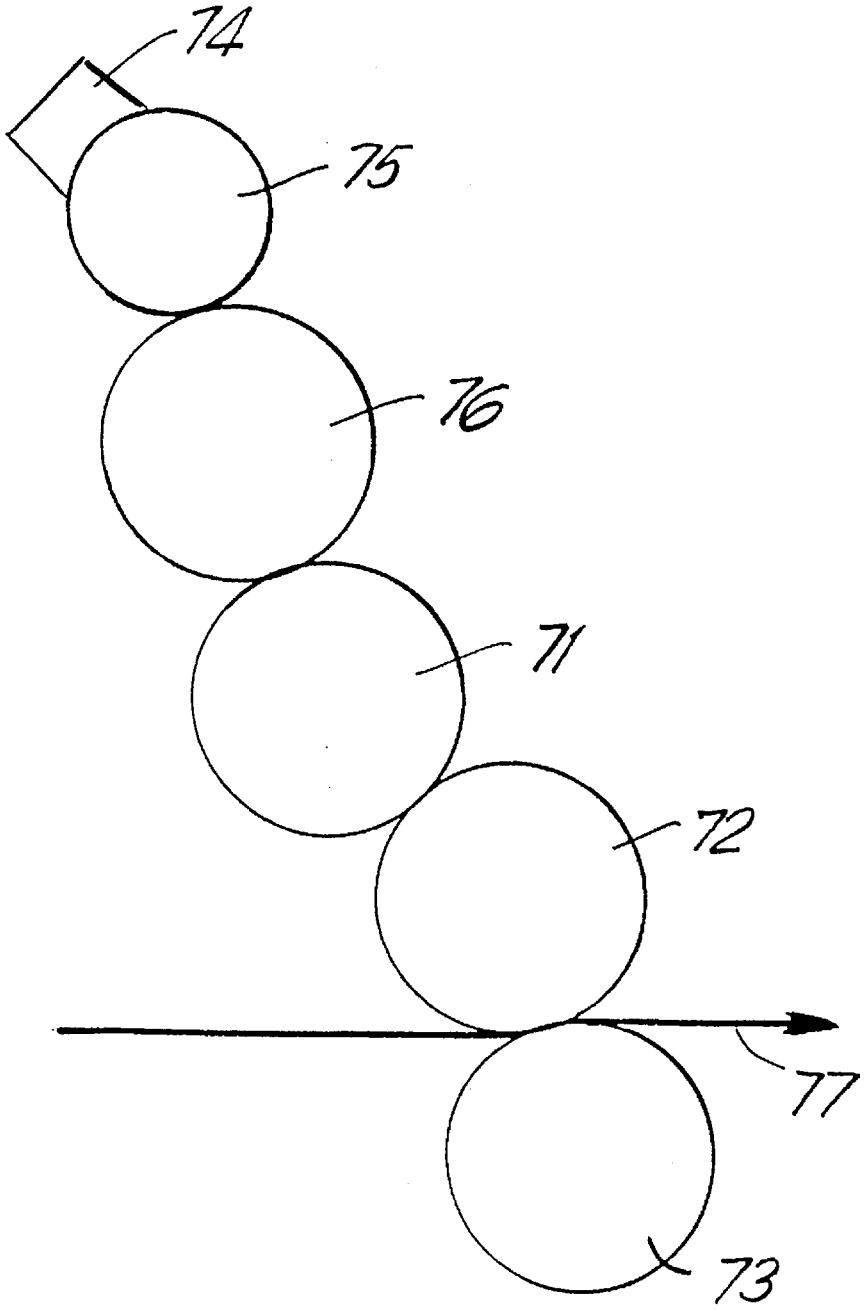
FIG. 5 schematically illustrates a three-cylinder printing mechanism.

The printing mechanism can also cooperate with an actual impression cylinder instead of with the transfer cylinder of another printing mechanism. Such a three-cylinder printing mechanism is shown in FIG. 5. It contains a form cylinder 71, a transfer cylinder 72 and an impression cylinder 73. The form cylinder 71 is inked by a short inking mechanism, i.e., an anilox inking mechanism. This inking mechanism contains a screen roller 75, which is inked by a doctor blade 74, and an applicator roller 76. The screen roller 75 inks the applicator roller 76 which in turn inks the printing form of the form cylinder 71. The latter transfers the printed image to the transfer cylinder 72 which prints on the web 77. The cooling devices have been left out of the drawing for the sake of simplicity.

Ionization rods are also advantageously used in printing mechanisms for waterless offset printing to eliminate electrostatic charge. In the embodiment according to FIG. 1, ionization rods 79, 80 are arranged on both sides of the web 21 after it has passed between the transfer cylinders 3, 4 which print upon it. Ionization rods can also be arranged upstream and/or downstream of the cylinders printing the web 21. The web, which is drier in waterless offset printing, has a greater tendency toward electrostatic charge and accordingly exerts a stronger attraction on dust particles from the environment. These dust particles settle on the transfer cylinder and are transmitted to the form cylinder resulting in printing problems. This problem is countered along with ink mist by the use of ionization rods. Further, sensitive electronic components which can be disrupted or destroyed when exposed to strong electrostatic fields are protected. Finally, the elimination of static electric charge makes it easier to detach the web from the cylinders printing the web. In this way it is possible to print with less web tension and to use lighter paper with less risk of tearing.

The invention is applicable not only to web-fed rotary printing presses but also to sheet-fed rotary presses, e.g., in a printing mechanism designed according to FIG. 5.

The invention is not limited by the embodiments described above which are presented as examples only but can be modified in various ways within the scope of protection defined by the appended patent claims.

We claim:

1. A printing mechanism for waterless offset printing, comprising: a frame having side walls, one of the side walls having an opening therein; a form cylinder; a transfer cylinder, the form cylinder and the transfer cylinder being rotatably mounted to the side walls of the frame; inking means for inking the form cylinder; means for cooling at least one of the transfer cylinder and the form cylinder; and a sleeve-shaped form removably mounted on at least one of the form cylinder and the transfer cylinder, the sleeve-shaped form being movable onto and off of the respective cylinder through the opening in the one of the side walls of the frame, a first of the side walls is at a drive side of the cylinders and a second of the side walls is on an operating side of the cylinders, and further comprising a gear case arranged at the side wall on the drive side, a heat exchanger in operative connection with the gear case, means for supplying coolant to the heat exchanger, a regulating valve and regulator for regulating coolant supply to the heat exchanger, and a separate thermal sensor arranged at each of the side walls and being connected to the regulator.

2. A printing mechanism according to claim 1, and further comprising means for internally cooling the transfer cylinder.

3. A printing mechanism according to claim 2, wherein the transfer cylinder has a neck that is mounted in one of the side walls of the frame, and further comprising connecting head means mounted to the neck for feeding and discharging coolant to and from the internal cooling means, the neck having a coolant feed duct and a coolant discharge duct.

4. A printing mechanism according to claim 3, wherein the sleeve-shaped form is mounted on the transfer cylinder and the transfer cylinder has a jacket provided with radial bores and a connection bore hole for guiding compressed air beneath the sleeve-shaped form to facilitate slide on and removal thereof.

5. A printing mechanism according to claim 2, wherein the internal cooling means includes a regulating valve and a thermal sensor arranged at the transfer cylinder for controlling a supply of coolant to the transfer cylinder.

6. A printing mechanism according to claim 1, and further comprising means for internally cooling the form cylinder.

7. A printing mechanism according to claim 6, wherein the form cylinder has a neck that is mounted in one of the sidewalls of the frame, and further comprising connecting head means mounted to the neck for feeding and discharging coolant to and from the internal cooling means, the neck having a coolant feed duct and a coolant discharge duct.

8. A printing mechanism according to claim 7, wherein the sleeve-shaped form is mounted on the form cylinder and the form cylinder has a jacket provided with radial bores and a connection bore hole for guiding compressed air beneath the sleeve-shaped form to facilitate slide-on and removal thereof.

9. A printing mechanism according to claim 6, wherein the internal cooling means includes a regulating valve and a thermal sensor arranged at the form cylinder for controlling a supply of coolant to the form cylinder.

10. A printing mechanism according to claim 1, wherein the inking means includes ink distributing rollers, and further comprising means for internally cooling the ink distributing rollers.

11. A printing mechanism according to claim 10, wherein the internal cooling means includes a regulating valve and a thermal sensor arranged at the ink distributing rollers for controlling a supply of coolant to the ink distributing rollers.

12. A printing mechanism according to claim 1, wherein the inking means includes an ink fountain roller, and further comprising means for internally cooling the ink fountain roller.

13. A printing mechanism according to claim 12, wherein the internal cooling means includes a regulating valve and a thermal sensor arranged at the ink fountain roller for controlling a supply of coolant to the ink fountain roller.

14. A printing mechanism according to claim 1, wherein the transfer cylinder has a jacket, the cooling means includes blowing means arranged so as to extend over a width of the cylinder jacket for blowing air against the transfer cylinder and the form cylinder.

15. A printing mechanism according to claim 14, further comprising an additional form cylinder and transfer cylinder arranged on an opposite side of a web, and wherein the blowing means includes blowers arranged on both sides of the web to be printed.

16. A printing mechanism according to claim 14, and further comprising at least one cooling station for generating coolant, the blowing means including a heat exchanger connectable to the at least one cooling station.

17. A printing mechanism according to claim 1, further comprising an impression cylinder formed by a transfer cylinder of another printing mechanism.

18. A printing mechanism according to claim 1, wherein the form cylinder and the transfer cylinder are mounted to the sidewalls of the frame so that a web can pass therebetween.

19. A printing mechanism according to claim 1, wherein the inking means is an anilox inking mechanism.

20. A printing mechanism according to claim 1, and further comprising ionization rods arrangeable at a web at least one of upstream and downstream of the cylinders printing the web to eliminate electrostatic charges.

21. A printing mechanism for waterless offset printing having no moistening device comprising:

a form cylinder and a transfer cylinder;

side walls for rotatably mounting said form cylinder and said transfer cylinder;

inking means for inking the form cylinder;

means for cooling said form cylinder and said transfer cylinder, one of said side walls is at a drive side of the cylinders and another of said side walls is on an operating side of said cylinders; a gear case arranged at said side wall on the drive side; a heat exchanger in operative connection with said gear case; means for supplying coolant to said heat exchanger; a regulating valve and a regulator for regulating coolant supply to said heat exchanger; and a separate thermal sensor arranged at each of said side walls and being connected to said regulator.

22. The printing mechanism according to claim 21, wherein said cooling means includes means for internally liquid cooling both said transfer cylinder and said form cylinder.

23. The printing mechanism according to claim 22, wherein at least one of said transfer cylinder and said form cylinder has a neck that is mounted in one of said side walls and further comprising connecting head means mounted to the neck for feeding and discharging coolant to and from said internal cooling means; said neck having a coolant feed duct and a coolant discharge duct.

24. The printing mechanism according to claim 21, wherein said inking means includes an ink fountain roller, and further comprising means for internally liquid cooling said ink fountain roller.

25. The printing mechanism according to claim 21, wherein said cooling means includes blowing means arranged so as to extend over a width of the cylinders for blowing air against said transfer cylinder and said form cylinder.

26. The printing mechanism according to claim 21, wherein said form cylinder and said transfer cylinder are mounted to the said side walls so that a web can pass therebetween.

27. The printing mechanism according to claim 21, wherein said inking means is an anilox inking mechanism.

28. The printing mechanism according to claim 21, further comprising ionization rods arrangeable at a web at least one of upstream and downstream of said cylinders printing the web for eliminating electrostatic charges.

* * * * *